US008338767B2

(12) United States Patent
Kulkarni

(10) Patent No.: US 8,338,767 B2
(45) Date of Patent: Dec. 25, 2012

(54) HINGE MECHANISM FOR A HOME APPLIANCE PROVIDING DOOR MOTION IN A NON-CIRCULAR PATH

(75) Inventor: Harish Prakash Kulkarni, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 389 days.

(21) Appl. No.: 12/702,494

(22) Filed: Feb. 9, 2010

(65) Prior Publication Data

US 2011/0192839 A1 Aug. 11, 2011

(51) Int. Cl.
*H05B 6/62* (2006.01)

(52) U.S. Cl. ..... 219/769; 219/702; 16/358

(58) Field of Classification Search ..... 16/358, 16/361, 362; 219/769, 702, 736, 738, 739, 219/756, 391–393, 399, 403, 412; 99/357; 312/405

See application file for complete search history.

(56) References Cited

U.S. PATENT DOCUMENTS

| | | | |
|---|---|---|---|
| 1,075,130 | A | 10/1913 | Streberger |
| 2,227,871 | A | 1/1941 | Wigell |
| 2,867,839 | A | 1/1959 | Squire |
| 3,001,225 | A | 9/1961 | Squire |
| 4,386,450 | A | 6/1983 | Krauss |
| 4,485,524 | A | 12/1984 | Neville |
| 4,912,865 | A | 4/1990 | Ellsworth et al. |
| 5,172,969 | A | 12/1992 | Reuter et al. |
| 5,725,279 | A | 3/1998 | Ward et al. |
| 6,050,358 | A | 4/2000 | Kays et al. |
| 6,493,906 | B2 | 12/2002 | Matteau |
| 6,945,621 | B2 | 9/2005 | Shin |
| 7,203,997 | B2 | 4/2007 | Morgan |
| 2003/0056328 | A1 | 3/2003 | Habegger |
| 2006/0032019 | A1 | 2/2006 | Kistner |
| 2008/0289144 | A1 | 11/2008 | Vanini |
| 2009/0165258 | A1 * | 7/2009 | Laundroche et al. ..... 16/430 |

OTHER PUBLICATIONS

International Search Report and Opinion, PCT/US2011/024144, issued May 30, 2011.

* cited by examiner

*Primary Examiner* — Matthew Reames
(74) *Attorney, Agent, or Firm* — Jason S. Burnette

(57) ABSTRACT

A cooking appliance includes a housing forming a food handling compartment, a door positioned at the front of the housing that is configured to rotate about a vertical axis, and a hinge assembly secured to the door. The hinge assembly includes a hinge pin extending along the vertical axis and a double slider-crank mechanism that is coupled to the hinge pin. As the door rotates about the vertical axis, the hinge assembly moves the vertical axis along an elliptical path.

18 Claims, 5 Drawing Sheets

HINGE MECHANISM FOR A HOME APPLIANCE PROVIDING DOOR MOTION IN A NON-CIRCULAR PATH

TECHNICAL FIELD

The present disclosure relates generally to a home appliance and more particularly to a hinge mechanism for a home appliance.

BACKGROUND

A home appliance is a device that is used to store or prepare foods in a home. Other home appliances are used to clean dishes and other wares dirtied in the process of preparing and consuming meals. Home appliances typically have doors that provide user access to the home appliance.

SUMMARY

According to one aspect, a home appliance includes a housing forming a food handling compartment, a door positioned at the front of the housing configured to rotate about a vertical axis, and a hinge pin secured to the door. The hinge pin is configured to rotate with the door about the vertical axis. The home appliance also includes a crank arm extending from a first end to a second end, and the first end is secured to the hinge pin. A first slider is pivotably coupled to the crank arm at the second end and is constrained to move along a first horizontal axis. A second slider is pivotably coupled to the crank arm between the first end and the second end and is constrained to move along a second horizontal axis extending perpendicular to the first horizontal axis. As the door rotates about the vertical axis, the crank arm acts on the first slider and the second slider to move the first slider along the first horizontal axis and the second slider along the second horizontal axis such that the vertical axis travels along an elliptical path.

In some embodiments, the home appliance may further include a hinge base coupled to the housing. The hinge base may have a first guide and a second guide defined in an upper end thereof. The first guide may be transverse to the second guide. The first slider may be positioned in the first guide, and the second slider may be positioned in the second guide.

In some embodiments, the first guide and the second guide may form a plus-shaped guideway in the hinge base. Additionally, in some embodiments, the home appliance may include a cover plate secured to the upper end of the hinge base. The cover plate may have a slot defined therein extending parallel to the second horizontal axis. The crank arm may be positioned below the cover plate, and the hinge pin may extend upwardly through the slot. In some embodiments, the hinge pin may be a hexagonal rod.

In some embodiments, the crank arm may be pivotably coupled to the first slider at a first pivot joint. The first pivot joint may have a second vertical axis extending therethrough. The crank arm may pivot about the second vertical axis as the door rotates about the vertical axis. In some embodiments, the crank arm may be pivotably coupled to the second slider at a second pivot joint, and the second pivot joint may have a third vertical axis extending therethrough. When the door is rotated about the vertical axis, the crank arm may be pivoted about the third vertical axis such that the first slider is moved along the first horizontal axis and the second slider is moved along the second horizontal axis.

In some embodiments, the housing may be a microwave housing, and the food handling compartment may be a microwave cooking chamber. In some embodiments, the housing may be a refrigerator housing, and the food handling compartment may a refrigerated storage compartment.

According to another aspect, a cooking appliance includes a housing having a food handling compartment, a door positioned at the front of the housing that is configured to rotate about an axis, and a hinge assembly secured to the door. The hinge assembly includes a crank arm extending from a first end to a second end. The first end is secured to the door. A first slider is pivotably coupled to the crank arm at the second end, and a second slider is pivotably coupled to the crank arm between the first end and the second end. As the door rotates about the axis, the crank arm acts on the first slider and the second slider such that the axis travels along an elliptical path.

In some embodiments, the crank arm may have a hexagonal rod extending from the first end, and the door may have a hole defined therein that receives the hexagonal rod. In some embodiments, the cooking appliance may further include a hinge base coupled to the housing below the door. The hinge base may have a first guide and a second guide defined therein. The first guide may extend perpendicular to the second guide. The first slider may be positioned in the first guide, and the second slider may be positioned in the second guide.

In some embodiments, the first slider may move along the first guide and the second slider may move along the second guide as the door rotates about the axis. Additionally, in some embodiments, the axis may be a vertical axis.

According to another aspect, a cooking appliance includes a housing forming a food handling compartment, a door positioned at the front of the housing that is configured to rotate about a vertical axis, and a hinge assembly secured to the door. The hinge assembly includes a hinge pin extending along the vertical axis and a double slider-crank mechanism coupled to the hinge pin. As the door rotates about the vertical axis, the hinge assembly moves the vertical axis along an elliptical path.

In some embodiments, the double slider-crank mechanism may include a crank arm extending from a first end to a second end. The first end may be secured to the hinge pin. A first slider may be pivotably coupled to the crank arm at the second end. The first slider may be moveable along a first horizontal axis. A second slider may be pivotably coupled to the crank arm between the first end and the second end. The second slider may be moveable along a second horizontal axis.

In some embodiments, the double slider-crank mechanism may include a hinge base coupled to the housing. The first slider and the second slider may be positioned in a plus-shaped guideway defined in the hinge base.

BRIEF DESCRIPTION OF THE DRAWINGS

The detailed description particularly refers to the following figures, in which.

DETAILED DESCRIPTION OF THE DRAWINGS

Figure 1:
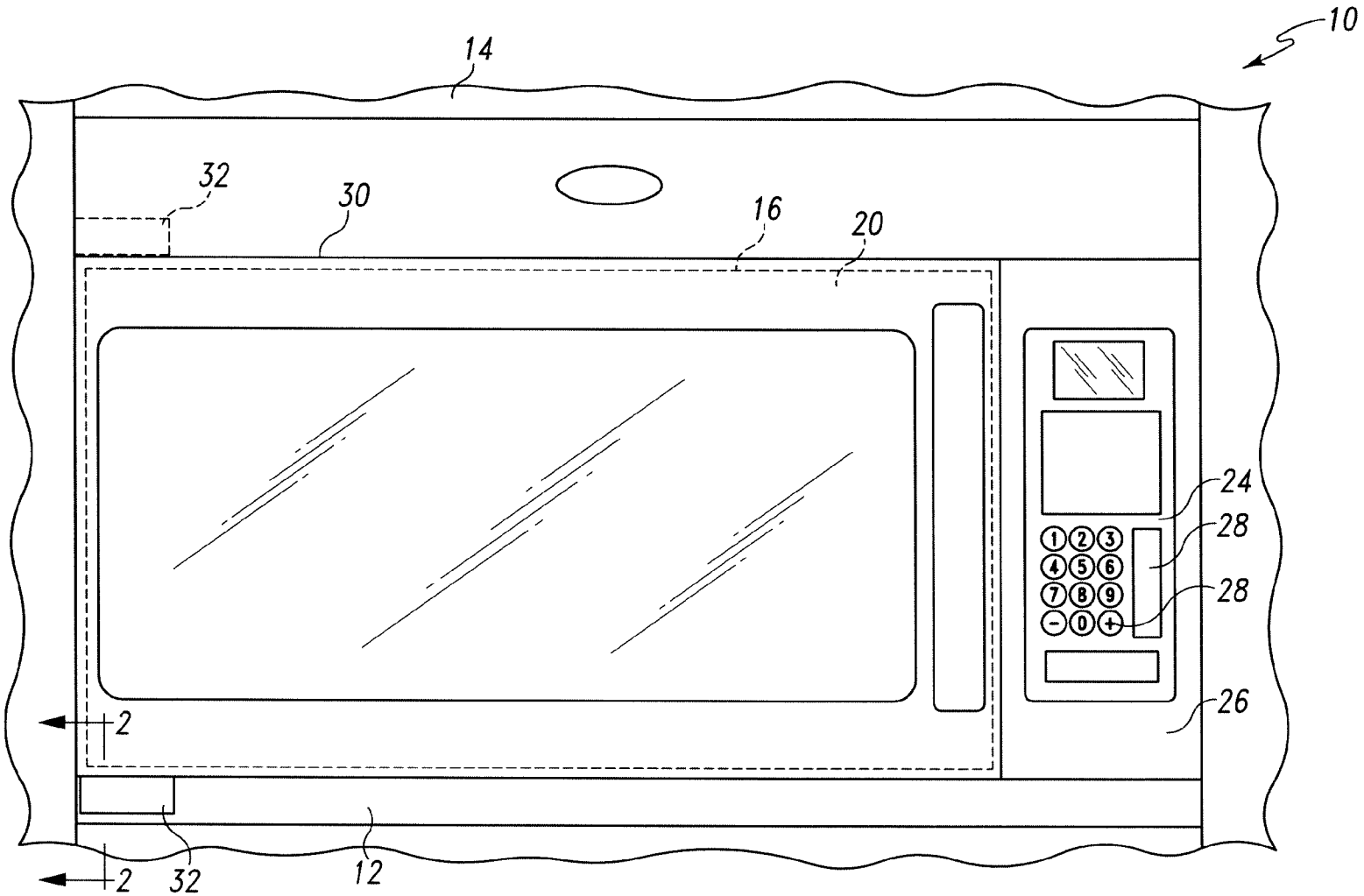
FIG. 1 is a front elevation view of a home appliance.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a home appliance is shown as a microwave cooking appliance 10 (hereinafter microwave 10). The microwave 10 has a housing 12 that is secured to a wall 14 of a home. The housing 12 defines a food handling compartment 16. The term "food handling compartment" is defined herein as a chamber or cavity formed within a home appliance into which a user may place dishes or other wares containing food or liquid to be heated or stored. For example, a food handling compartment may be a cooking chamber of an oven. Alternatively, a food handling compartment may be a refrigerated storage compartment in a refrigerator. In the microwave 10, the food handling compartment 16 is a microwave cooking chamber 20 into which pans, sheets, or other cookware are placed to be heated.

A user may control the operation of the microwave 10 using a control interface 24, which is located on a front panel 26 of the housing 12. The control interface 24 includes a set of push buttons 28 that are connected to an automated control system (not shown) operable to control the operation of the microwave 10. For example, the user may enter the amount of time the microwave 10 should cook the food or liquid placed within the cooking chamber 20, and the microwave 10 will respond by supplying heat to the cooking chamber 20 for the programmed amount of time.

A door 30 is hinged to the front of the housing 12 via a pair of hinge assemblies 32. The door 30 is configured to permit or prevent user-access to the cooking chamber 20, which is provided through an access opening. User-access to the cooking chamber 20 is prevented when the door 30 is closed, and when the door 30 is open, user-access to the cooking chamber 20 is permitted.

Figure 2:
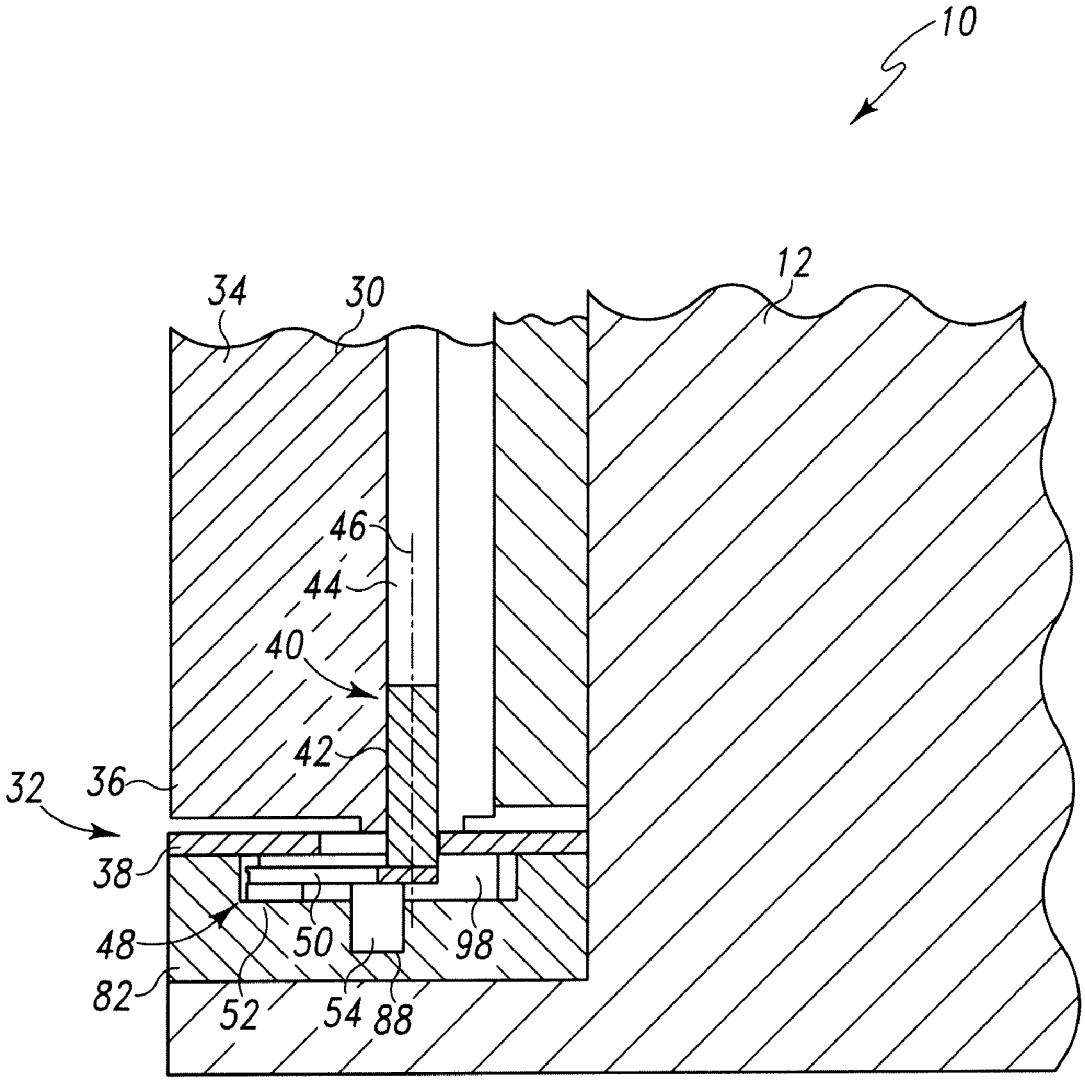
FIG. 2 is a fragmentary cross-sectional side elevation view of the home appliance of FIG. 1 taken along the line 2-2.

Referring now to FIGS. 2-6, the door 30 and one of the hinge assemblies 32 are shown in greater detail. As shown in FIG. 2, the door 30 includes a door panel 34 extending upwardly from a bottom end 36. The bottom end 36 of the door 30 is positioned on a cover plate 38 of the hinge assembly 32, and the bottom end 36 is secured to the hinge assembly 32 via a hinge pin 40. The hinge pin 40 is a hexagonal rod 42 (see FIG. 3) that is received in a hexagonal-shaped aperture 44 formed in the bottom end 36. When the door 30 is opened or closed, the door 30 rotates relative to the front of the housing 12 about a vertical axis 46 defined by the hinge pin 40. The matching cross-sections of the rod 42 and the aperture 44 do not permit relative motion between the hinge pin 40 and the door 30. As such, the hinge pin 40 rotates with the door 30 about the axis 46 when the door is opened. It will be appreciated that in other embodiments the rod 42 may have a different cross-section, such as, for example, a square or other multi-sided cross-section that does not permit relative motion between the hinge pin 40 and the door 30. It will be further appreciated that the rod 42 may be a cylindrical shaft that is fixed to the door 30 such that relative movement between the hinge pin 40 and the door 30 is not permitted.

Figure 3:
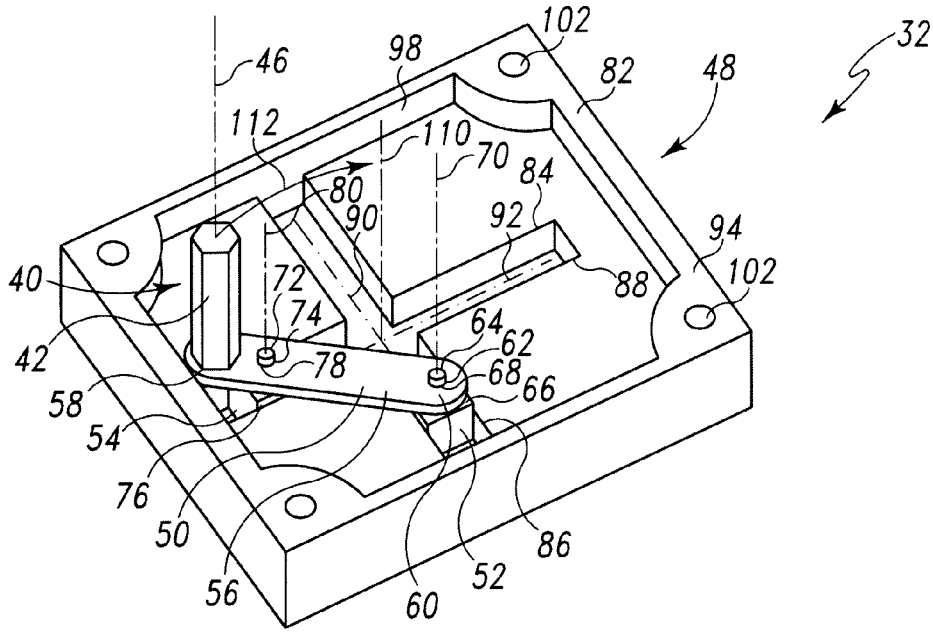
FIG. 3 is a perspective view of the hinge mechanism of the home appliance of FIG. 1 with the hinge pin located in one position.
Figure 4:
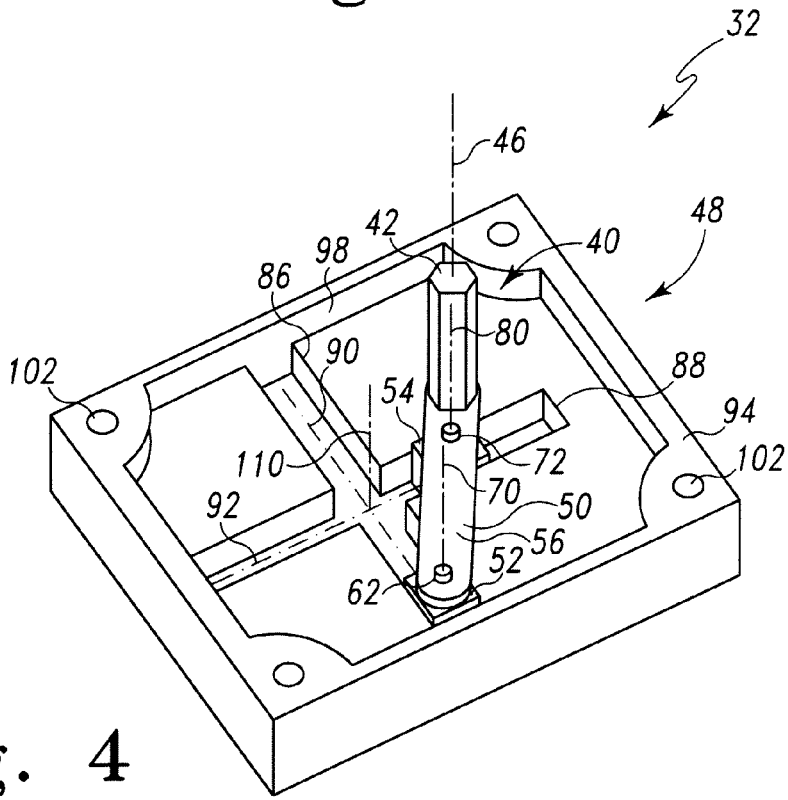
FIG. 4 is a perspective view of the hinge mechanism of the home appliance of FIG. 1 with the hinge pin located in another position.

As best seen in FIGS. 3 and 4, the hinge assembly 32 also includes a double slider-crank mechanism 48 positioned below the cover plate 38. The double slider-crank mechanism 48 includes a crank arm 50 pivotably coupled to a pair of slider blocks 52, 54. The crank arm 50 has a linkage 56 that extends from a first end 58 to a second end 60. As shown in FIG. 3, the hinge pin 40 is secured to the first end 58 of the linkage 56.

The slider block 52 is coupled to the second end 60 of the linkage 56 at a pivot joint 62. The pivot joint 62 includes a cylindrical pivot pin 64 that extends upwardly from an upper end 66 of the slider block 52 through a hole 68 defined in the linkage 56. As will be described in greater detail, when the door 30 is opened or closed, the linkage 56 pivots about an axis 70 defined by the pivot joint 62.

The slider block 54 is coupled to the linkage 56 at a pivot joint 72 positioned between the first end 58 and the second end 60. As shown in FIG. 3, the pivot joint 72 is positioned closer to the first end 58 than the second end 60. The pivot joint 72, like the pivot joint 62, includes a cylindrical pivot pin 74 that extends upwardly from an upper end 76 of the slider block 54 through a hole 78 defined in the linkage 56. As will be described in greater detail, when the door 30 is opened or closed, the linkage 56 pivots about an axis 80 defined by the pivot joint 72.

The slider blocks 52, 54 are positioned in a hinge base 82. As shown in FIG. 2, the hinge base 82 is secured to the housing 12 of the microwave 10 and is positioned below the door 30. Returning to FIGS. 3 and 4, the hinge base 82 has a cross or plus-shaped guideway 84 defined therein. The guideway 84 includes a pair of guides 86, 88 that are positioned traverse and orthogonal to each other. As shown in FIG. 3, the guide 86 extends along a horizontal axis 90, and the guide 88 extends along another horizontal axis 92 extending perpendicular to the axis 90. The slider block 52 is received in the guide 86 and is constrained to move along the axis 90. The slider block 54 is received in the guide 88 and is constrained to move along the axis 92.

The hinge base 82 includes a side wall 94 that extends above the crank arm 50 and the slider blocks 52, 54. The sidewall 94 defines a chamber 98 into which a lubricant such as grease, gel, or oil may be added to facilitate the movement of the slider blocks 52, 54 along the axes 90, 92 as well as the pivoting of the linkage 56 about the axes 70, 80. The cover plate 38 is secured to the side wall 94 of the hinge base 82 via a number of bolts 100 (see FIG. 5), which are received in a corresponding number of apertures 102 formed in the side wall 94 of the hinge base 82. In that way, the cover plate 38 provides the moving parts of the hinge assembly 32 some protection against the interference of dust and other particles. Additionally, the cover plate 38 decreases the risk of injury by limiting access to the moving parts.

As shown in FIGS. 3-6, when the door 30 is opened, the door 30 and the hinge pin 40 rotate about the vertical axis 46. The rotation of the hinge pin 40 causes the crank arm 50 to rotate about the axes 70, 80. Because the linkage 56 of the crank arm 50 fixes the distance between the pivot joints 62, 72, the crank arm 50 applies a force to the slider blocks 52, 54 while rotating about the axes 70, 80, thereby causing the slider blocks 52, 54 to move within the guides 86, 88. As the slider blocks 52, 54 move along the horizontal axes 90, 92, the hinge pin 40 is moved along an elliptical path about a vertical axis 110, as illustrated by arrow 112 in FIGS. 3 and 5. In that way, the vertical axis 46 is not fixed as the door 30 is opened or closed. Instead, the vertical axis 46 travels along the path indicated by the arrow 112.

Figure 5:
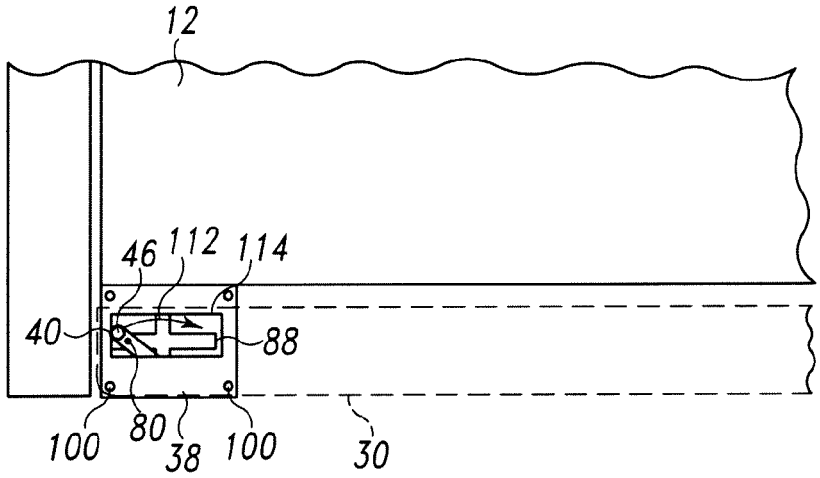
FIG. 5 is a fragmentary top elevation view of the home appliance of FIG. 1 with the hinge pin located in the position shown in FIG. 3.
Figure 6:
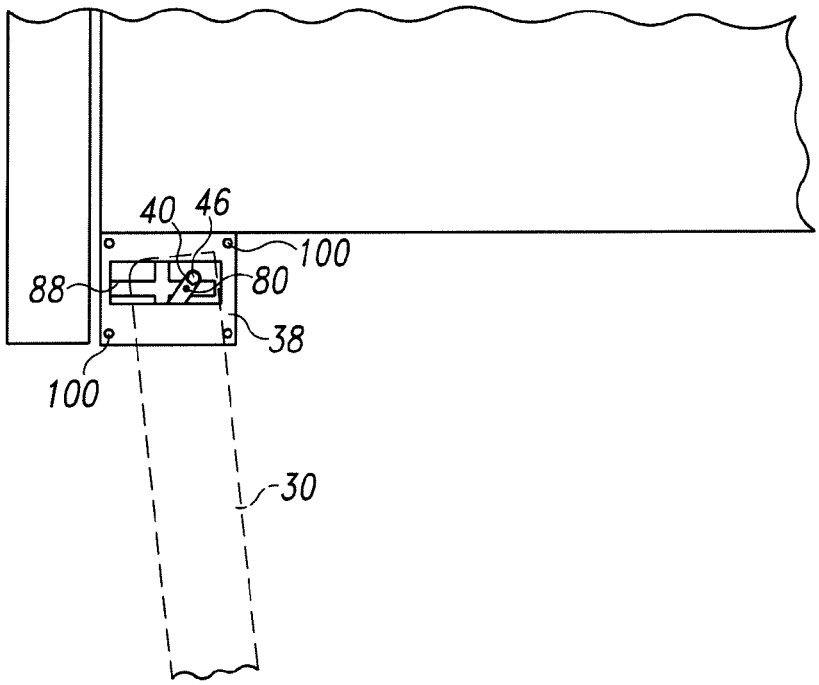
FIG. 6 is a fragmentary top elevation view of the home appliance of FIG. 1 with the hinge pin located in the position shown in FIG. 4.

As shown in FIGS. 3 and 5, when the door 30 is closed, the hinge pin 40 and, thus, the vertical axis 46, are located in one position. When the door 30 is opened, the hinge assembly 32 moves the hinge pin 40 and the vertical axis 46 along the path shown by the arrow 112 to another position, as shown in FIGS. 4 and 6. The hinge pin 40 extends upwardly through a slot 114 defined in the cover plate 38. The slot 114 extends along the horizontal axis 92 and is sized such that the hinge pin 40 may move freely along the elliptical path as the door is opened and closed.

Figure 7:
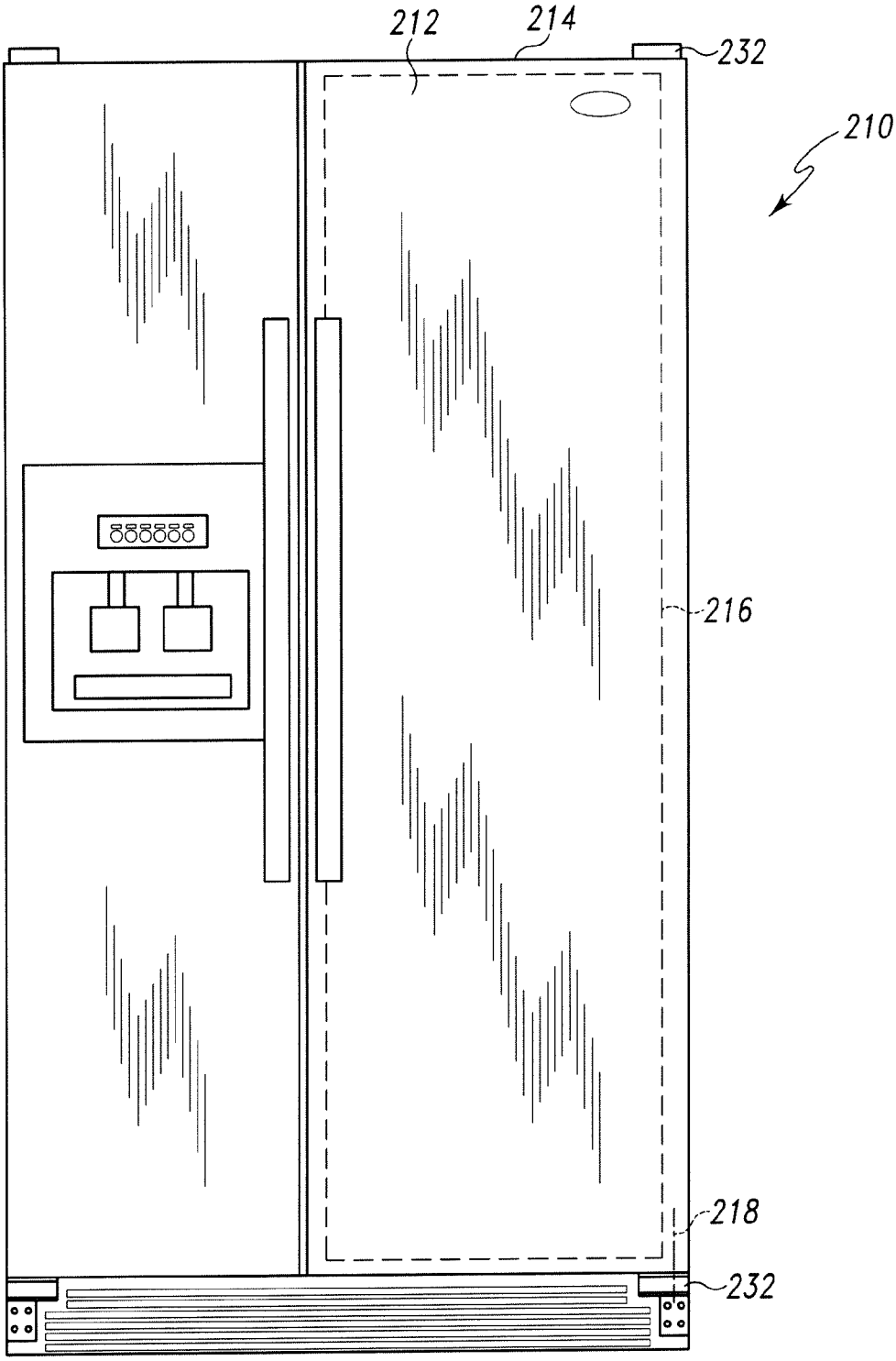
FIG. 7 is a front elevation view of another home appliance including a hinge mechanism similar to that shown in FIGS. 3-6.

The hinge assembly 32 described above may be resized to be used with other home appliances such as, for example, refrigerator 210 shown in FIG. 7. The refrigerator 210 has a door 212 that is hinged to the front of a housing 214 via another pair of hinge assemblies 232. Like the microwave 10 discussed above, the door 212 is configured to permit or prevent user-access to a food handling compartment, which is a refrigerated storage compartment 216. User-access to the storage compartment 216 is prevented when the door 212 is closed, and, when the door 212 is open, user-access to the storage compartment 216 is permitted.

The door 212 of the refrigerator 210 is configured to rotate about a vertical axis 218 while being opened or closed. As the door 212 rotates about the vertical axis 218, the hinge assembly 232 moves the vertical axis 218 along an elliptical path in the manner described above. In that way, the vertical axis 218 is not fixed as the door 212 is opened or closed.

It will be appreciated that the hinge assembly described above may be used with other home appliances. For example, the hinge assembly may be used with refrigerators or ice makers that require flush installation with the kitchen cabinetry. Additionally, the hinge assembly 32 may be configured to be used with an oven door of a cooking range or the door of a dishwasher. In such embodiments, a spring mechanism or other rotary damper may be used to stop the door in a desired location. Additionally, a spring could also be employed to exert a bias on the door such that the door will automatically close when the door is released.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A home appliance comprising:

a housing forming a food handling compartment, a door positioned at the front of the housing, the door being configured to rotate about a vertical axis, a hinge pin secured to the door, the hinge pin being configured to rotate with the door about the vertical axis, a crank arm extending from a first end to a second end, the first end being secured to the hinge pin, a first slider pivotably coupled to the crank arm at the second end, the first slider being constrained to move along a first horizontal axis, and a second slider pivotably coupled to the crank arm between the first end and the second end, the second slider being constrained to move along a second horizontal axis extending perpendicular to the first horizontal axis, wherein as the door rotates about the vertical axis, the crank arm acts on the first slider and the second slider to move the first slider along the first horizontal axis and the second slider along the second horizontal axis such that the vertical axis travels along an elliptical path.

2. The home appliance of claim 1, further comprising a hinge base coupled to the housing, the hinge base having a first guide and a second guide defined in an upper end thereof, wherein:

the first guide is transverse to the second guide, the first slider is positioned in the first guide, and the second slider is positioned in the second guide.

3. The home appliance of claim 2, wherein the first guide and the second guide form a plus-shaped guideway in the hinge base.

4. The home appliance of claim 2, further comprising a cover plate secured to the upper end of the hinge base, the cover plate having a slot defined therein extending parallel to the second horizontal axis, wherein:

the crank arm is positioned below the cover plate, the hinge pin extends upwardly through the slot.

5. The home appliance of claim 1, wherein the hinge pin is a hexagonal rod.

6. The home appliance of claim 1, wherein:

the crank arm is pivotably coupled to the first slider at a first pivot joint, the first pivot joint having a second vertical axis extending therethrough, and the crank arm pivots about the second vertical axis as the door rotates about the vertical axis.

7. The home appliance of claim 6, wherein:

the crank arm is pivotably coupled to the second slider at a second pivot joint, the second pivot joint having a third vertical axis extending therethrough, and when the door is rotated about the vertical axis, the crank arm is pivoted about the third vertical axis such that the first slider is moved along the first horizontal axis and the second slider is moved along the second horizontal axis.

8. The home appliance of claim 1, wherein the housing is a microwave housing, and the food handling compartment is a microwave cooking chamber.

9. The home appliance of claim 1, wherein the housing is a refrigerator housing, and the food handling compartment is a refrigerated storage compartment.

10. A cooking appliance comprising:

a housing having a food handling compartment, a door positioned at the front of the housing, the door being configured to rotate about an axis, and a hinge assembly secured to the door, the hinge assembly comprising:

a crank arm extending from a first end to a second end, the first end being secured to the door, a first slider pivotably coupled to the crank arm at the second end, and a second slider pivotably coupled to the crank arm between the first end and the second end, wherein as the door rotates about the axis, the crank arm acts on the first slider and the second slider such that the axis travels along an eccentric path.

11. The cooking appliance of claim 10, wherein the crank arm has a hexagonal rod extending from the first end, and the door has a hole defined therein that receives the hexagonal rod.

12. The cooking appliance of claim 10, further comprising:

a hinge base coupled to the housing below the door, the hinge base having a first guide and a second guide defined therein, the first guide extending perpendicular to the second guide, the first slider is positioned in the first guide, and the second slider is positioned in the second guide.

13. The cooking appliance of claim 12, wherein the first slider moves along the first guide and the second slider moves along the second guide as the door rotates about the axis.

14. The cooking appliance of claim 12, wherein the axis is a vertical axis.

15. The cooking appliance of claim 10, wherein the housing is a microwave housing, and the food handling compartment is a microwave cooking chamber.

16. A cooking appliance comprising:

a housing forming a food handling compartment, a door positioned at the front of the housing, the door being configured to rotate about a vertical axis, and a hinge assembly secured to the door, the hinge assembly including a hinge pin extending along the vertical axis and a double slider-crank mechanism coupled to the hinge pin, wherein as the door rotates about the vertical axis, the hinge assembly moves the vertical axis along an eccentric path.

17. The cooking appliance of claim 16, wherein the double slider-crank mechanism includes:

a crank arm extending from a first end to a second end, the first end being secured to the hinge pin, a first slider pivotably coupled to the crank arm at the second end, the first slider being moveable along a first horizontal axis, and a second slider pivotably coupled to the crank arm between the first end and the second end, the second slider being moveable along a second horizontal axis.

18. The cooking appliance of claim 17, wherein the double slider-crank mechanism includes a hinge base coupled to the housing, and the first slider and the second slider are positioned in a plus-shaped guideway defined in the hinge base.

* * * * *